US006739130B2

(12) United States Patent
Prampolini

(10) Patent No.: US 6,739,130 B2
(45) Date of Patent: May 25, 2004

(54) LINEAR ACTUATOR

(76) Inventor: Silvano Prampolini, Via Verdi, 50-41030 Bomporto, Modena (IT)

( * ) Notice: Subject to any disclaimer, the term of this patent is extended or adjusted under 35 U.S.C. 154(b) by 77 days.

(21) Appl. No.: 10/247,831

(22) Filed: Sep. 20, 2002

(65) Prior Publication Data

US 2003/0091448 A1 May 15, 2003

(30) Foreign Application Priority Data

Oct. 30, 2001 (EP) ..... 01830676

(51) Int. Cl.[7] ..... F15B 15/18
(52) U.S. Cl. ..... 60/476; 91/508
(58) Field of Search ..... 60/476, 473, 472; 91/508, 172; 92/138

(56) References Cited

U.S. PATENT DOCUMENTS

| | | | |
|---|---|---|---|
| 4,351,153 A | 9/1982 | Kosmala | |
| 5,117,633 A | 6/1992 | Bayer et al. | |

FOREIGN PATENT DOCUMENTS

| | | | |
|---|---|---|---|
| CH | 386854 | 1/1965 | |
| DE | 2002/0051 | 3/2001 | |
| DE | 20020051 U1 * | 3/2001 | ..... A01G/3/02 |
| EP | 0936380 | 8/1999 | |
| GB | 2359871 | 9/2001 | |
| GB | 2359871 A * | 9/2001 | ..... F16K/31/42 |

OTHER PUBLICATIONS

EPO Search Report EP 01 83 0676 Sep. 2002.

* cited by examiner

*Primary Examiner*—Thomas E. Lazo
(74) *Attorney, Agent, or Firm*—Geoffrey B. Myers, Esq.

(57) ABSTRACT

The linear actuator comprises two variable-volume chambers (5) containing an operative liquid, each of the chambers (5) being delimited on one side by one of two mobile elements (4), which mobile elements (4) are solidly constrained one to another. One of the mobile elements (4) is connectable to an external user, for example a gearwheel of a gear coupling. A geared rotary positive displacement pump (10) reversibly transfers the operating liquid from one chamber (5) to the other chamber (5) through an infeed conduit (6), to move the mobile elements (5) selectively in one direction or another. A recycling conduit (7), narrower than the infeed conduit (6), places the two chambers (5) in communication and realizes a closed circuit, in a situation where the mobile elements 4) are stationary and the pump (10) is active.

19 Claims, 2 Drawing Sheets

LINEAR ACTUATOR

FOREIGN APPLICATION DATA

This application claims priority of Italian Patent Application No. 01830676.1 filed Oct. 30, 2001, and invented by Silvano Prampolini.

DESCRIPTION

Specifically, though not exclusively, the invention can be used for enmeshing gears used, for example, in power take-offs applied in vehicle transmissions. In particular, the linear actuator of the invention, when applied to a gear clutch, must be able to control a precisely-staged sequential engagement operation, wherein an axially-mobile gear is brought into contact with an axially-fixed gear wheel and is kept pressed against the latter until, by effect of a relative rotation, the gears of one wheel coincide with those of the other and enmeshing takes place. The actuator of the invention must also include an endrun stage, in which the enmeshing is completed, and a return run for de-clutching.

Many and various prior art solutions are proposed for linear actuators, able to carry out the following functions: for example, EP 0 936 380 describes an actuator which solves a series of problems and drawbacks in prior art actuators. However these prior art solutions, including EP 0 936 380, can be improved in various ways.

Firstly, improvements can be made in constructional simplicity and reduction of mass.

Secondly ease of manoeuvre for the operator can be improved.

Thirdly, functional reliability is open to improvement.

The main aim of the present invention is to obviate the above limitations and drawbacks of the prior art.

An advantage of the invention is that it provides an actuator which is constructionally simple and of small mass.

A further advantage consists in the ease and immediacy with which the actuator can be manoeuvred and controlled.

A further advantage is the reliability of the actuator of the invention.

These aims and advantages and others besides are all attained by the present invention, as it is characterised in the appended claims.

Further characteristics and advantages of the present invention will better emerge from the detailed description that follows of a preferred but non-exclusive embodiment of the invention, illustrated purely by way of non-limiting example in the accompanying figures of the drawings, in which.

Figure 1:
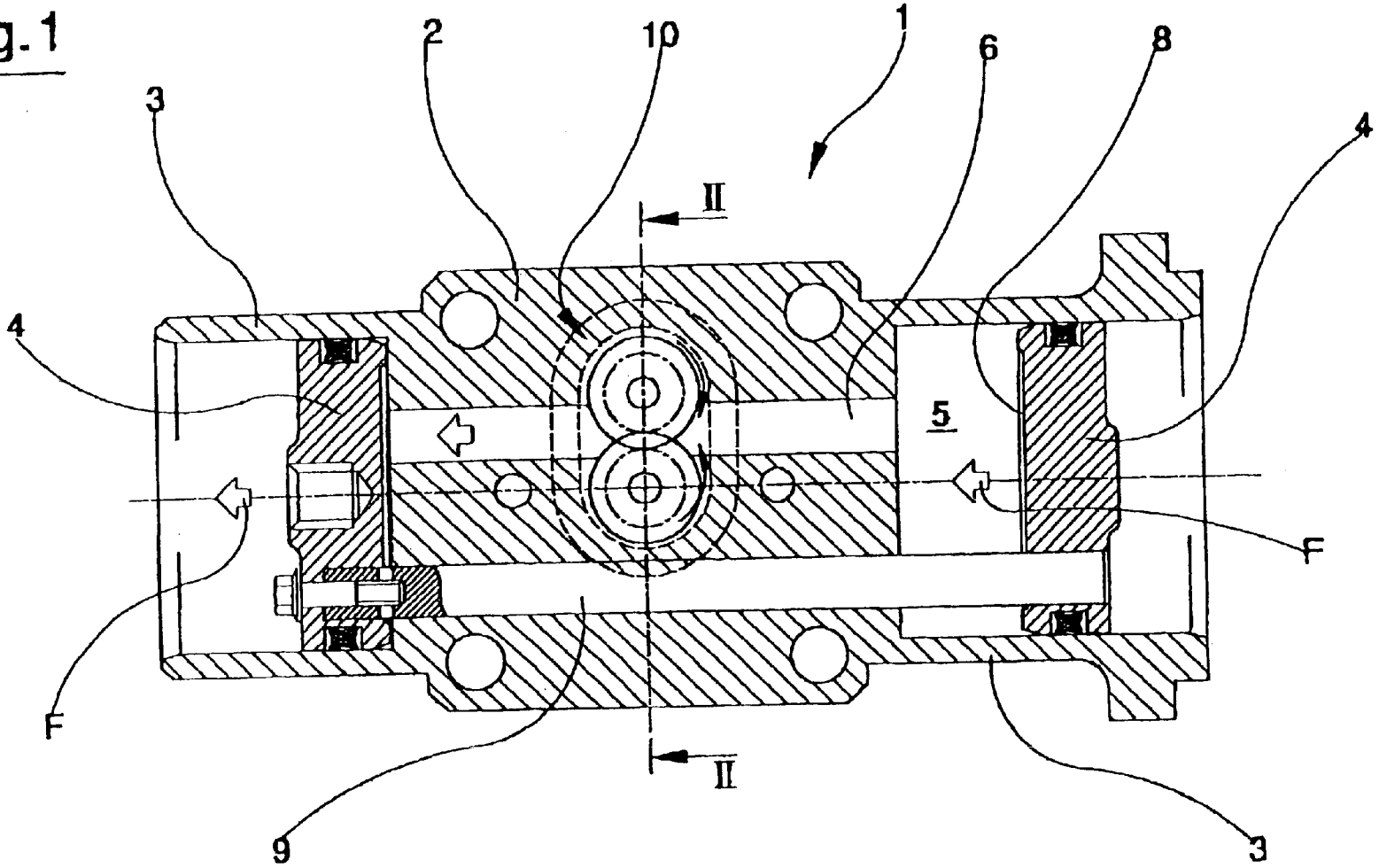
FIG. 1 is a section of an embodiment of the invention according to line I—I of FIG. 2.

With reference to the figures of the drawings, 1 denotes in its entirety a linear actuator comprising a main body 2 bearing at two opposite ends thereof two coaxial cylindrical sleeves 3. Each sleeve 3 internally exhibits a sliding seating for an axially-mobile element 4, or piston, which has at least one lateral ring seal. The two opposite sliding seatings, like the two mobile elements 4 which slide inside them, are coaxial and their transversal sections are of equal areas. The actuator 1 has two variable-volume opposite cylindrical chambers 5, filled with the operating liquid. Each chamber 5 is laterally delimited by each of the two sliding seatings, and delimited at ends thereof by two opposite facing bases: a mobile base being an internal face of the mobile element 4 and a fixed base located on the main body 2.

Two conduits are afforded between the two variable-configuration chambers 5: a first infeed conduit 6 and a second recycling conduit 6. Both conduits 6 and 7 place the two liquid-filled chambers 5 in mutual communication. Each conduit 6 and 7 has opposite ends which terminate in the chambers 5 at the fixed end bases of the main body 2.

The recycling conduit 7, which places the two chambers 5 in communication, can be made differently to the configuration shown in the figures of the drawings. For example, it could be made by increasing the transversal section of the bore constituting the housing of the con rod 9 above the transversal section strictly necessary for enabling an axially-sliding relative coupling.

Figure 3:
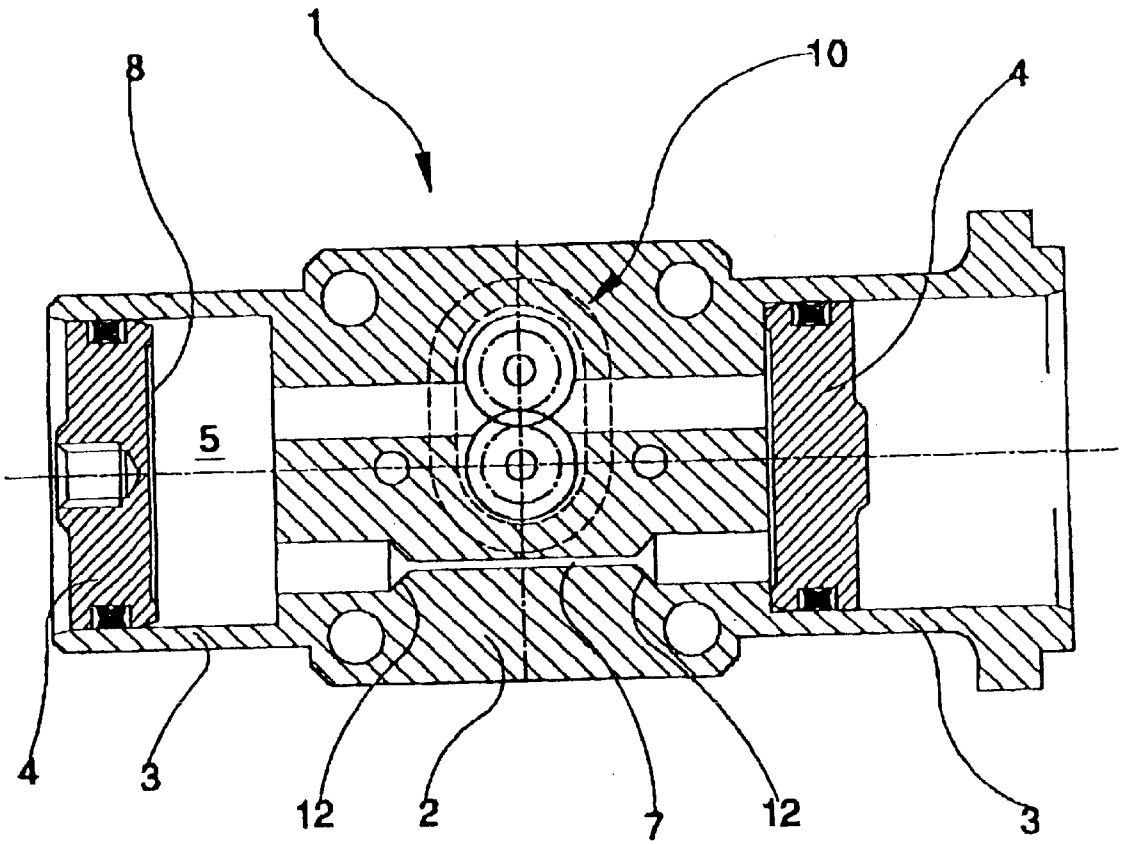
FIG. 3 shows section III—III of FIG. 2.
Figure 2:
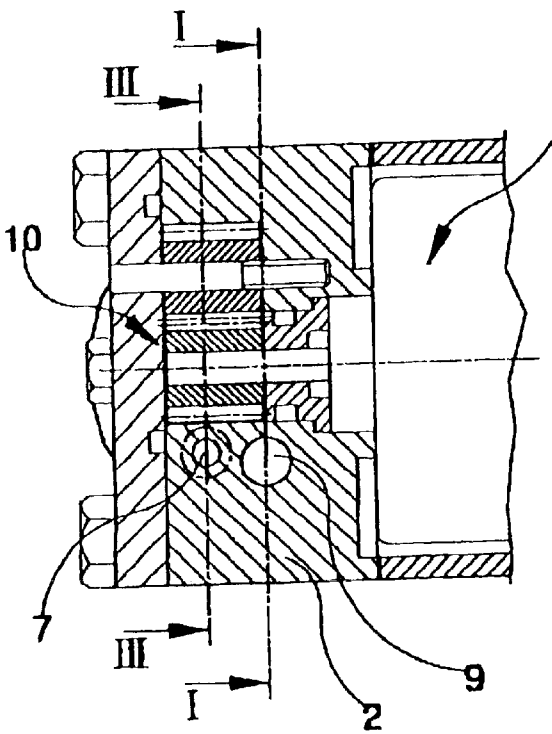
FIG. 2 shows section II—II of FIG. 1.

Each mobile element 4 exhibits, on the internal face delimiting a chamber 5, a recess 8 which ensures that the chamber 5 never reaches zero volume, not even in the mobile element 4 endrun position (on the right in FIG. 3; on the left in FIG. 1).

The two mobile elements 4 are interconnected and depend on each other so that when one moves the other is also displaced. In other words, if either one of the mobile elements 4 is subjected to a force causing it to move, the other mobile element 4 is also drawn into movement.

Preferably the connection between the two mobile elements 4 is rigid, as in the described embodiment, in which the mobile elements 4 are solidly connected to each other by means of at least one rigid con rod 9 extending in a parallel direction to the displacement axis of the mobile elements 4. The con rod 9 has opposite ends which are fixed to two mobile elements 4, constraining the mobile elements 4 solidly one to the other. The con rod 9 is inserted and axially slidable in a through-hole afforded in the main body 2.

A pump 10 reversibly transfers the liquid from one chamber to the other through the infeed conduit 6, selectively moving the mobile elements 4 in one direction or another. The pump 10 is at least partially housed in an internal cavity of the main body 2. The pump 10 of the present embodiment is a rotary positive-displacement pump comprising at least one blower operating in the infeed conduit 6. The blower is preferably (as illustrated) of the geared type. The pump 10 is rotated by a motor 11 mounted in a casing made solid to the main body 2. The recycling conduit 7, together with the infeed conduit 6, make a closed hydraulic circuit also comprising the two chambers 5. This closed circuit is particularly useful in a situation in which the mobile elements 4 are still and the pump 10 is in action, as will be better explained herein below.

The recycling conduit 7 and the infeed conduit 6 are conformed so that a loss of load or loss of total pressure in the recycling conduit 7 is greater than in the infeed conduit 6: this condition can be obtained, as is known, in various ways: for example, the diameter of the recycling conduit 7 can be constant and smaller than the diameter, also constant, of the infeed conduit; or the recycling conduit 7 can have one or more chokes. Preferably, as in the illustrated example, the recycling conduit 7 will have three tracts of different diameters united by a central tract of conduit, with two sharp changes of diameter where the central tract joins with the wider-diameter tracts. These sharp diameter changes will function as localised resistances. The narrowest tract of the recycling conduit 7 (i.e. the central tract) is smaller than the diameter, preferably constant, of the infeed conduit 6. Preferably the losses of load on the recycling conduit 7 are significantly greater and sharper than the losses of load on the infeed conduit 6, with the result that the total resistances (continuous or localised) to liquid movement along the recycling conduit 7 are considerably greater than the total resistances along the infeed conduit 6. To this end the diameter of the narrow central tract of the recycling conduit 7 can be, for example, less than one third of the diameter of the infeed conduit 6, or, preferably, less than one fifth. The diameter of the larger end tracts of the recycling conduit 7 can be, for example, about the same as the diameter of the indeed conduit 6. The two end tracts could also have the same diameter as the central tract.

At least one of the two mobile elements 4 (in this case the mobile element 4 on the left in FIGS. 1 and 3) is destined to be connected (for example by a screw-connection) with an external user, which could be for example an axially-mobile gear wheel of a gear coupling (of known type and not illustrated) for a power take-off. For this purpose the mobile element 4 is provided with suitable means, of known type, for achieving this connection. The linear actuator 1 is however utilisable in general for commanding a reversible axial displacement of any cursor.

The actuator operates as follows.

To command the advancement of a cursor connected to one of the mobile elements 4 (in this particular case by "advancement" a displacement towards the left as indicated by arrow F is intended) starting from the endrun position, completely retracted in which one chamber 5 (on the right in FIG. 1) exhibits a maximum volume and the opposite chamber 5 (on the left in FIG. 1) exhibits a minimum volume. Operating the pump 10 in one direction causes transfer of the operating liquid from one chamber 5 to the other chamber 5 through the infeed conduit 6 on which the pump 10 operates, and the consequent displacement of the mobile elements 4 in direction F. During this phase if the mobile elements 4 (in particular the mobile element 4 which is operatively associated to the cursor or external user) meet no resistance (or in any case small-entity resistance) to their movement, the head of liquid along the recycling conduit 7 will be null or insignificant, or in any case lower than the head of liquid in the infeed conduit 6; thus the mobile elements 4 will be displaced by the action of the pump 10. If at least one of the mobile elements 4 meets a strong resistance (for example, if, in a gear coupling, the gear wheel drawn by the actuator meets the fixed wheel at a point where the gears of the two wheels are not perfectly aligned and therefore cannot enmesh), the mobile elements 4 stop while the pump 10 remains rotatingly active. In this situation of equilibrium a complete recycling of the liquid is automatically set in operation, with the result that the head of liquid going in one direction along the infeed conduit 6 is substantially equal to the head of liquid returning through the recycling conduit 7. As soon as the resistance to movement of the mobile elements 4 ceases (for example due to the gearwheels enmeshing as one of them rotates) the mobile elements 4 recommence moving in direction F, by effect of the transfer of the operative liquid from the pump 10, up until the fully-advanced endrun position is reached (corresponding for example to the fully-enmeshed situation). In this situation (FIG. 3) the pump 10 can continue rotating, as stopping it is not necessary in the exact moment that it reaches the endrun position: though liquid transfer continues, the return of the liquid through the recycling conduit 7 ensures the liquid is supplied to the pump (thus lubricating the pimp) and prevents a chamber 5 from drying 5. The presence, then, of a closed hydraulic circuit guarantees good actuator functioning even when the pump is working but not displacing the mobile elements 4.

To retract the mobile elements 4 (for example to de-clutch the gearwheels), it is sufficient to drive the pump 10 in inverse direction with respect to before (in the specific case of the present embodiment it is enough to rotate the rotary pump in the opposite direction, for example by inverting the polarity of the electric motor powering the pump 10), so that the liquid is transferred from the fuller chamber 5 (on the left in the figure) to the emptier chamber 5 (on the right in the figure) through the infeed conduit 6, thus displacing the mobile elements 4 in an opposite direction to F; for the retracting phase too, when the endrun situation is reached (or any other situation causing the mobile elements 4 to stop), the pump 10 can continue to transfer liquid through the infeed conduit 6, since thanks to the recycling conduit 7 continual liquid circulation is guaranteed.

A three-way lever switch (forwards OFF, reverse) can be used to command the pump, with the lever normally left in the central OFF position; if so desired, OFF could incorporate automatic reverse. Otherwise two buttons could be installed, one for advance motion and one for return. The pump 10 could also be operated manually, in which case the operator could keep the activating organ (lever, button or other) in the active position unproblematically even when the mobile elements 4 of the actuator are still. The operator could allow the switch to return to OFF when he or she notices, for example by effect of the activation of a relative signal, that the mobile elements 4 have reached an endrun position which corresponds to the completion of the operation being carried out (for example enmeshing or de-clutching gears in a power take-off). The actuator can be made to function as a single-acting cylinder, with a specially-calibrated valve fitted on the recycling conduit and a return spring acting coaxially on the mobile element 4 which exerts the direct action on the gear coupling.

In this configuration the con rod 9 might not be necessary as the drawing action on the mobile element 4 opposite the one connected to the user (coupling) could be produced by the depression which would be created in the chamber 5 in which the mobile element 4 itself operates.

What is claimed is:

1. A linear actuator, comprising:

two chambers containing an operating liquid;

two mobile elements, one for each of the two chambers, each mobile element delimiting a side of one of the two chambers and being axially mobile along one of two sealed sliding seatings of the chamber, the two mobile elements being connected one to the other so that a movement of one of the mobile elements will determine a movement of the other of the mobile elements; at least one of the mobile elements being designed for connection to an external user;

a pump for reversibly flowing the operating liquid from one of the two chambers to the other of the two chambers through an infeed conduit, in order to move the two mobile elements selectively in one direction or in another direction;

a recycling conduit which places the two chambers in communication for enabling a closed-circuit circulation to be established when the two mobile elements are stationary and the pump is activated.

2. The linear actuator according to claim 1 further comprising a main body which exhibits, at two opposite ends thereof, the two sealed sliding seatings arranged coaxially, each sealed sliding seating having a transversal area equal to the other, the infeed conduit and the recycling conduit being arranged between the two chambers and located internally of the main body, each of the conduits terminating at sides of the chambers which sides are opposite the sides of the chambers which are delimited by the mobile elements.

3. The linear actuator of claim 2 characterized in that the pump is at least partially housed in an internal cavity located in the main body.

4. The linear actuator according to claim 3 characterized in that the pump is a rotary positive displacement pump.

5. The linear actuator according to claim 4 characterized in that the pump comprises at least one blower operating in the infeed conduit.

6. The linear actuator according to claim 5 characterized in that the two mobile elements are coaxial and are solidly connected one to another.

7. The linear actuator according to claim 6 further comprising a longitudinal con rod which is parallel to an axis of the mobile elements, and which has opposite ends which are fixed to the two mobile elements solidly constraining the two mobile elements one to another, and which is axially slidable inside a through-hole of the main body which exhibits the two sliding seatings.

8. The linear actuator according to claim 7 characterized in that each mobile element of the mobile elements exhibits, on a face delimiting the chamber, a recess for preventing a zero volume of the operating liquid therein at an endrum position of a mobile element of the mobile elements.

9. The linear actuator according to claim 8 characterized in that the recycling conduit and the infeed conduit are conformed such that a loss of total pressure in the recycling conduit is greater than a loss of pressure in the infeed conduit.

10. The linear actuator according to claim 9 characterized in that the recycling conduit, which places the two chambers in mutual communication, is constructed by increasing a transversal section of the through-hole housing the con rod above a transversal section which is necessary for axially slidably coupling the con rod therein.

11. A gear coupling, in particular for a power take off, comprising at least two gear wheels, at least one of which is axially mobile in two directions for enmeshing and for declutching, characterized in that the linear actuator is the linear actuator according to claim 10.

12. The linear actuator according to claim 3 characterized in that the pump comprises at least one blower operating in the infeed conduit.

13. The linear actuator according to claim 1, 2, or 3 characterized in that the pump is a rotary positive displacement pump.

14. The linear actuator according to claim 1, 2, 3, 4, or 12 characterized in that the two mobile elements are coaxial and are solidly connected one to another.

15. The linear actuator according to claim 14 further comprising a longitudinal con rod which is parallel to an axis of the mobile elements, and which has opposite ends which are fixed to the two mobile elements solidly constraining the two mobile elements one to another, and which is axially slidable inside a through-hole of the main body which exhibits the two sliding seatings.

16. The linear actuator according to claim 1, 2, 3, 4, 12, 5, or 6 characterized in that each mobile element of the mobile elements exhibits, on a face delimiting the chamber, a recess for preventing a zero volume of the operating liquid therein at an endrum position of a mobile element of the mobile elements.

17. The linear actuator according to claim 1, 2, 3, 4, 12, 5, 6, or 7 characterized in that the recycling conduit and the infeed conduit are conformed such that a loss of total pressure in the recycling conduit is greater than a loss of pressure in the infeed conduit.

18. The linear actuator according to claim 1, 2, 3, 4, 12, 5, 6, 7, or 8 characterized in that the recycling conduit, which places the two chambers in mutual communication, is constructed by increasing a transversal section of the through-hole housing the con rod above a transversal section which is necessary for axially slidably coupling the con rod therein.

19. A gear coupling, in particular for a power take off, comprising at least two gear wheels, at least one of which is axially mobile in two directions for enmeshing and for declutching, characterized in that the linear actuator is the linear actuator according to claim 1, 2, 3, 4, 12, 5, 6, 7, 8, or 9.

* * * * *